United States Patent [19]

Day

[11] 4,062,396

[45] Dec. 13, 1977

[54] METHOD OF MAKING A UNITARY PATTERN ASSEMBLY

[75] Inventor: Edward George Day, Rocky Hill, Conn.

[73] Assignee: United Technologies Corporation, Hartford, Conn.

[21] Appl. No.: 646,804

[22] Filed: Jan. 5, 1976

[51] Int. Cl.[2] ..... B22C 7/00

[52] U.S. Cl. ..... 164/15; 164/45; 164/235

[58] Field of Search ..... 164/45, 235, 241, 242, 164/243, 246, 15; 249/62; 264/220, 225, 275

[56] References Cited

U.S. PATENT DOCUMENTS

| | | | |
|---|---|---|---|
| 2,844,855 | 7/1958 | Godd et al. | 164/10 |
| 3,029,485 | 4/1962 | McCormick | 164/246 |
| 3,254,379 | 6/1966 | Poe | 164/246 X |
| 3,562,900 | 2/1971 | Buehler | 164/45 X |
| 3,766,966 | 10/1973 | Perisse | 164/45 UX |
| 3,848,654 | 11/1974 | Boyle et al. | 164/246 X |
| 3,985,176 | 10/1976 | Wamester | 164/45 |

*Primary Examiner*—Ronald J. Shore
*Attorney, Agent, or Firm*—Edward J. Timmer

[57] ABSTRACT

This invention involves a method of making a unitary pattern assembly which is useful in forming investment shell molds for the conventional and directional solidification of molten metals and alloys. It comprises providing a fixture having first and second pattern capturing means, providing a mold structure having a cavity, positioning the mold structure and fixture to expose the capturing means to the cavity, forming a pattern in the cavity and removing the mold structure from the pattern. A unitary pattern assembly comprising a fixture and pattern fixedly captured therein is obtained. Multiple patterns may also be captured in the fixture. The method is especially suitable for making a pattern assembly useful in the production of gas turbine engine blades by the "lost wax" process.

32 Claims, 3 Drawing Figures

METHOD OF MAKING A UNITARY PATTERN ASSEMBLY

BACKGROUND OF THE INVENTION

1. Field of the Invention

This invention relates to a method for making a unitary pattern assembly useful in investment casting and, more particularly, to a method for making a unitary pattern assembly useful in forming investment shell molds for the conventional and directional solidification of molten metals and alloys.

2. Description of the Prior Art

The present invention finds particular application in the production of gas turbine engine blades and like components. Turbine blades have been produced primarily by the method known as the "lost wax" process in which a wax pattern of the blade is provided and thereafter repeatedly dipped in a ceramic slurry, such as a zircon slurry, and dried until a shell of adequate thickness is formed thereon. The shelled pattern is then heated to a temperature that will melt the wax so that it flows out of the shell leaving behind a shell mold into which molten metal is poured and either conventionally or directionally solidified to produce the turbine blade. Obviously, the formation and maintenance of the wax pattern in the exact replica of the turbine blade is crucial in achieving a satisfactory casting, since any distortion in the wax pattern will be manifested in the shell mold formed therearound and in the subsequently cast turbine blade.

In the practice of the prior art, distortion of the wax pattern occurs most frequently during the manual assembly of the pattern assembly components. For example, it is common practice to form the pattern in a mold and manually remove the pattern therefrom. The pattern is joined to a wax coated metal support base, a sprue and runners are then joined to the pattern and a pour cup is thereafter joined to the sprue, the joining usually being done manually by wax welding. A handle is generally wax welded to the pour cup to provide a means for manipulating the pattern assembly during shell mold formation operations. If the assembly is structurally weak, a wax coated metal support plate may be wax welded to the pour cup and wax coated metal rods welded between the support base and support plate. This assembly procedure is one of the most critical operations in the entire investment casting process; if improperly done so as to distort the pattern, it can be a major cause of defective castings.

In efforts to overcome the inadequacies in the prior art practice, other workers have reported one-step and two-step injection molding processes for making a pattern assembly. In the one-step injection molding process, the pattern, runner and pour cup are formed as a one-piece assembly by the injection of molten wax into a suitable die in which a metal pour cup insert has been placed. After formation of the pattern assembly, a ceramic ring is wax welded to the pour cup to provide location and mechanical support means for subsequent processing operations. In the two-step injection molding process, the patterns are individually injected and then placed within an assembly die having sprue, runner and pour cup passages therein. A pour cup insert is placed in the die as in the one-step injection process. Molten wax is injected into the die to form a one-piece pattern assembly comprising the individual patterns connected to the sprue, runners and pour cup. A ceramic ring is then wax welded to the pour cup. The pattern assemblies produced by the disclosed processes are thereafter subjected to conventional shell mold formation operations.

Although an improvement over the prior art practice, the one-step and two-step injection molding processes suffer from several disadvantages. Both processes require that a metal pour cup insert be placed within the die prior to injection of the wax. Both processes also require that a ceramic ring be attached manually to the pour cup to provide location and support means for later operations. Also, neither process is amenable for use in the directional solidification of molten metals wherein the shell mold must have an open bottom to allow a chill plate to contact the molten metal, as taught in the Ver Snyder patent, U.S. Pat. No. 3,260,505. This is a serious disadvantage since modern gas turbine engines rely on directionally solidified turbine blades for improved performance characteristics. A disadvantage associated specifically with the one-step process is its limited capacity for producing a pattern assembly containing more than one or two patterns. Obviously, in the commercial production of turbine blades, it may be desirable to provide a pattern assembly having three, four or more patterns incorporated therein. Likewise, the two-step process is deficient in that the wax patterns are injection molded individually and must then be transported to and placed within the assembly die for attachment to sprue, runners and pour cup. Further, the joints between the pre-formed wax patterns and sprue are often characterized by objectionable roughness, such as ridges, which are a possible source of casting defects.

SUMMARY OF THE INVENTION

The present invention provides a method of making a unitary pattern assembly which is useful in forming investment shell molds for conventional and directional solidification of molten metals and alloys and which overcomes the disadvantages of the prior art, as enumerated above.

It is an object of the invention to provide a method of making a unitary pattern assembly which increases dimensional control of the pattern prior to and during shell mold formation operations and, consequently, increases the yield of satisfactory investment castings.

It is another object of the invention to provide a unitary pattern assembly which is readily adapted for use in automated techniques for making investment shell molds.

In the practice of the present invention we provide a fixture, said fixture having first and second pattern capturing means rigidly spaced a predetermined distance from one another; provide a mold structure having a cavity therein; position the mold structure and the fixture to expose said capturing means to the cavity; form a pattern in the cavity, said pattern being fixedly captured at each end by said capturing means; and remove the mold structure from the pattern, said pattern remaining fixedly captured between said capturing means in the fixture. A unitary pattern assembly comprising a fixture and pattern fixedly captured therein is thus obtained.

If desired, multiple patterns can be captured individually in the fixture by providing a plurality of first pattern capturing means therein and repeating the method of the invention until the desired number of patterns is formed and fixedly captured. Or, multiple patterns can be captured in a pattern cluster by utilizing in the method of the invention a mold structure having a cavity in the shape of said cluster. If only a partial pattern cluster can be produced in the cavity of the mold structure, the method of the invention is repeated until a complete cluster is formed and fixedly captured in the fixture.

If further desired, cores, inserts and the like may be incorporated into the pattern by placing them within the cavity of the mold structure prior to formation of the pattern.

These and other objects of the invention will appear from the following description of preferred embodiment which is given here by way of example only and with reference to the following drawing.

DESCRIPTION OF THE PREFERRED EMBODIMENT

Although the method of the invention is particularly applicable to making a unitary pattern assembly useful in the production of gas turbine engine blades by the "lost wax" process, it is equally applicable to investment casting processes generally, wherein a shell mold is to be formed on a pattern.

Figure 1:
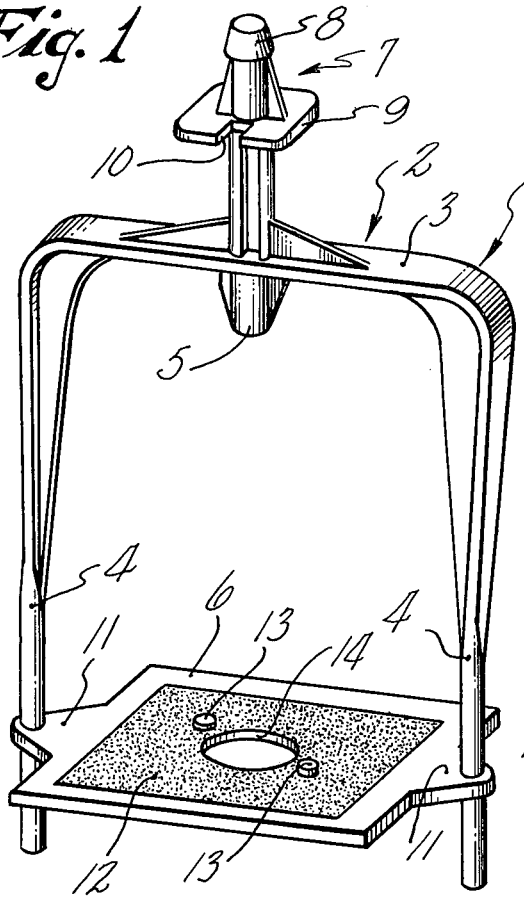
FIG. 1 is a schematic perspective illustration of a fixture of the preferred embodiment.

Referring now to FIG. 1, a fixture 1 is shown as comprising a yoke 2, which includes a support member 3, having first pattern capturing means 5, and leg members 4, rigidly engaged to a second pattern capturing means 6. Other configurations of fixture 1 may be used, however, so long as the first and second pattern capturing means 5 and 6 are rigidly spaced in an opposed relationship to one another by a predetermined distance related to the length of the pattern. For example, a fixture having a "C" shape and comprising a support member, having first pattern capturing means, rigidly spaced from the second pattern capturing means by a single leg member is within the scope of the invention.

As mentioned, yoke 2 is comprised of a support member 3, having first pattern capturing means 5, and leg members 4. The configuration and dimension of members 3 and 4 are selected to provide yoke 2 with sufficient strength and rigidity to resist bending and flexing after it is engaged with the second pattern capturing means 6. Yoke 2 may be of one-piece construction, such as molded plastic, die cast metal or the like, or may be constructed of individual members suitably attached together, such as by bolting, clamping, welding or the like.

Preferably, a handle means 7 may be removably attached to yoke 2 or integral therewith to provide a means for manipulating the pattern assembly during shell mold formation and other operations. It may be located in any suitable position on yoke 2 and may be adapted, such as by knob 8 and collar 9, to engage a manipulating device (not shown). Collar 9 may have a notch 10 therein to facilitate orientation in the device.

Figure 3:
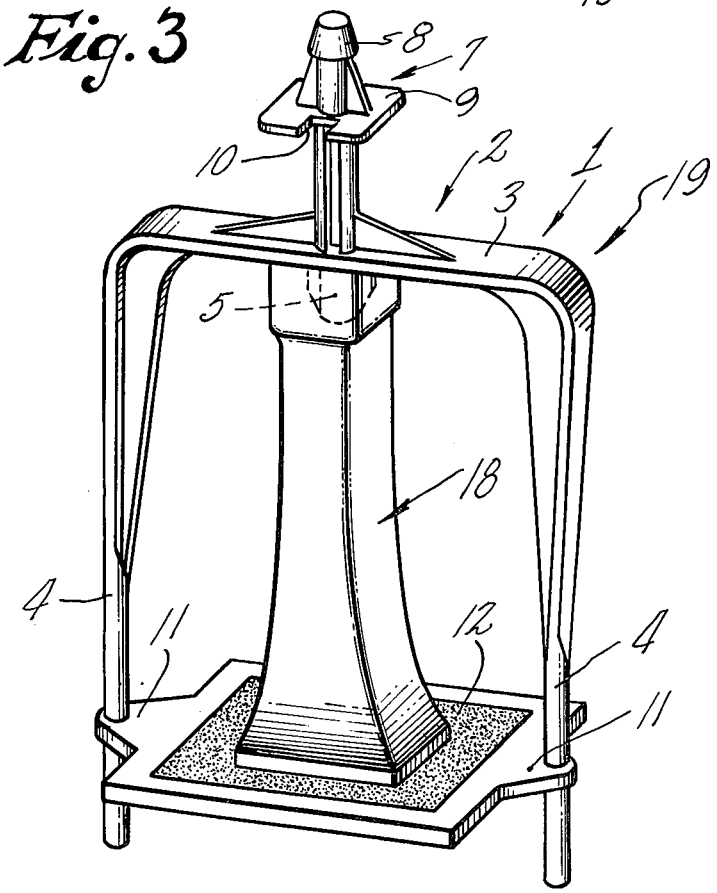
FIG. 3 is a schematic perspective illustration of a unitary pattern assembly comprising a fixture and pattern fixedly captured therein.

First pattern capturing means 5 may be removably attached to or integral with support member 3 of yoke 2 and is positioned thereon to obtain the desired pattern alignment. As shown in FIG. 1, it may be an elongated member, such as a finned cylinder, extending from support member 3 toward second pattern capturing means 6. Other shapes, such as a cone, rod or the like, are also suitable. Alternatively, the first pattern capturing means 5 may be a recess, such as a slot, hole or the like, in support member 3. The recess is constructed so that pattern material cannot escape therethrough. In addition to aligning and anchoring the pattern at one end, as shown in FIG. 3, the first pattern capturing means 5 also provides a so-called slip joint where, if needed, the pattern can shrink upon cooling without detaching from its means of support.

To rigidly space the pattern capturing means 5 and 6 in an opposed relationship to one another by a predetermined distance related to the length of the pattern to be formed, the second pattern capturing means 6 is rigidly engaged at an appropriate location to leg members 4 by suitable engagement means 11. The second pattern capturing means 6 is shown as a plate but may be of any configuration which is compatible with the pattern to be formed. It must possess sufficient strength to rigidly support the pattern during shell mold formation operations and may be made of plastic, metal or the like. The engagement means 11 may be removably attached to or integral with the second pattern capturing means 6 and may include lugs, clamps, pins or other conventional means. Although the second pattern capturing means 6 is shown engaged in substantially parallel alignment with the first pattern capturing means 5, other spatial relationships may be desirable under other circumstances.

It may be desirable to provide a roughened area 12 on the second pattern capturing means 6 to facilitate the adherence of the pattern thereto. If desired, a locking member 13 may be provided on the second pattern capturing means 6 to further anchor the pattern thereto.

It is oftentimes desirable to obtain uniform shrinkage of the pattern upon cooling. This is achieved by maintaining the cross section of the pattern substantially uniform throughout its length. One means of accomplishing this is to insert members (not shown) into the cavity of the mold to displace pattern material at areas of greater cross section. Second pattern capturing means 6 may be provided with a suitable opening 14 to allow introduction of such a displacement member into the mold cavity. It should be noted that the first pattern capturing means 5, if selected to project downwardly from support member 3 in an appropriate shape, can also provide a means for reducing the cross section of the pattern adjacent thereto.

Figure 2:
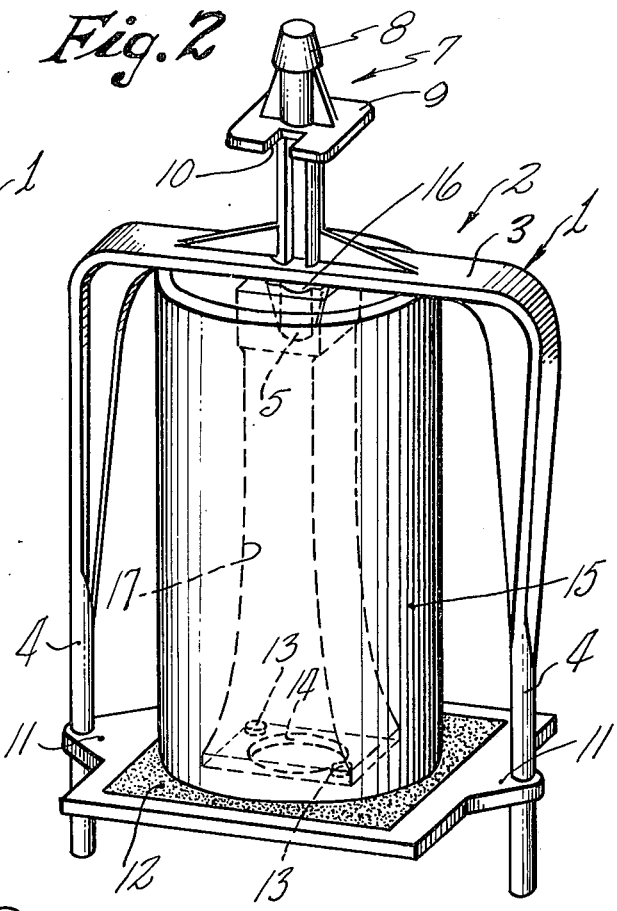
FIG. 2 is a schematic perspective illustration of the fixture and mold structure cooperatively positioned to expose the pattern capturing means to the cavity within the mold structure.

After the second pattern capturing means 6 is rigidly engaged to leg members 4 and thereby rigidly spaced oppositely from the first pattern capturing means 5 by the predetermined distance, the mold structure 15 and fixture 1 are cooperatively positioned so that the pattern capturing means 5 and 6 are exposed through suitably disposed openings 16 to the cavity 17 in mold structure 15, as shown in FIG. 2. The mold structure 15 should possess sealing means (not shown) to preclude the pattern material from exiting the mold cavity 17 where the pattern capturing means 5 and 6 enter and may be comprised of two or more connectable parts to facilitate positioning within fixture 1. Mold structures of the type described are well known in the prior art. After proper positioning is achieved, a pattern is formed in cavity 17, which has the shape of the article to be cast, by introducing pattern material, such as molten wax, therein. The pattern capturing means 5 and 6, exposed within the cavity, fixedly capture the pattern 18 at each end as it is formed. A pattern having a base integral therewith may be formed by providing in mold structure 15 a cavity comprising a pattern section and base section and then positioning the mold structure 15 and fixture 1 to expose said first capturing means 5 to the pattern section and said second capturing means 6 to the base section of the cavity. A pattern having a base integral therewith is then formed in the cavity, the pattern being fixedly captured at its end by the first capturing means and the base being fixedly captured by the second capturing means. This procedure may be desirable and preferred in certain directional solidification processes, especially those which are automated, wherein the investment shell mold is supported by a base on a chill plate. Injection of molten wax into the cavity 17 is the preferred method of forming the pattern or the pattern having a base integral therewith.

If desired, cores, inserts and the like may be incorporated into the pattern 18 by placing them within the cavity 17 of mold structure 15 prior to introduction of the pattern material. This technique may be used, for example, in producing turbine blades having cooling passages therein.

To obtain the unitary pattern assembly 19 of FIG. 3, the mold structure 15 is removed from the pattern 18, pattern 18 remaining fixedly captured between capturing means 5 and 6 in fixture 1. The pattern assembly 19 may thereafter be transported by handle means 7 to shell mold formation operations, wherein the assembly 19 is repeatedly dipped in a ceramic slurry and dried to form a shell (not shown) thereon. The shelled pattern is then separated from the shelled fixture by conventional means, such as sawing or the like, and subjected to dewaxing or like operations. Fixture 1 may then be cleaned to remove the shell thereon and reused in the method of the invention.

At no time after the pattern is formed and fixedly captured in the fixture does it contact anything but the mold cavity and ceramic slurry. In addition, the pattern is subjected to only minimal stresses during shell mold formation operations since it is supported at each end by the pattern capturing means. Thus, the method of the invention provides a unitary pattern assembly which increases dimensional control of the pattern prior to and during shell mold formation operations and, thereby, increases the yield of satisfactory investment castings. It also provides a pattern assembly which can be readily adapted for use in automated techniques for making investment shell molds.

If desired, multiple patterns may be captured individually in the fixture by providing a plurality of first pattern capturing means along the support member, each of said capturing means being associated with a single pattern to be formed. The steps of the method are then performed repeatedly until the desired number of patterns is formed and fixedly captured. For example, the mold structure and fixture are initially positioned to expose one first pattern capturing means and the second pattern capturing means to the cavity of the mold structure. A pattern is formed and fixedly captured between said capturing means, as described above, and the mold structure removed therefrom. The mold structure and fixture are then repositioned translationally to expose another first pattern capturing means and the second pattern capturing means to the cavity to form and fixedly capture another pattern. This sequence is repeated until a unitary pattern assembly comprising a fixture having the desired number of patterns fixedly captured individually therein is obtained.

Multiple patterns may also be captured in the fixture in a pattern cluster wherein each pattern is connected by a runner to a central pour cup. This arrangement is produced by utilizing in the method of the invention a mold structure having a cavity in the shape of said cluster. Or, if the cavity is in the shape of only a partial pattern cluster, the method of the invention is repeated until a complete cluster is formed and fixedly captured in the fixture.

Although the invention has been shown and described with respect to illustrative embodiments thereof, it should be understood by those skilled in the art that the foregoing and various other changes may be made without departing from the scope of the invention.

Having thus described typical embodiments of my invention, that which I claim as new and desire to secure by Letters Patent of the United States is:

1. A method of making a unitary pattern assembly useful in forming investment shell molds for the conventional and directional solidification of molten metals and alloys comprising the steps of:

a. providing a fixture, said fixture having first and second pattern capturing means rigidly spaced in open opposed relationship a predetermined distance from one another, the fixture being removable after investment molding and before casting and solidification;

b. providing a mold structure having a cavity therein;

c. positioning the mold structure and the fixture to expose said capturing means to the cavity;

d. forming a pattern in the cavity, said pattern being fixedly captured at each end by said capturing means; and e. removing the mold structure from the pattern, said pattern remaining fixedly captured by said capturing means in the fixture.

2. The method of claim 1 wherein said fixture is comprised of a support member, having a first pattern capturing means, rigidly spaced from the second pattern capturing means by at least one leg member.

3. The method of claim 2 wherein said first pattern capturing means is an elongated member extending from the support member toward the second pattern capturing means.

4. The method of claim 3 wherein said elongated member is in the shape of a finned cylinder.

5. The method of claim 2 wherein said first pattern capturing means is provided by said support member having a recess therein.

6. The method of claim 2 wherein said second pattern capturing means is a plate.

7. The method of claim 6 wherein said plate is provided with a roughened area thereon.

8. The method of claim 6 wherein said plate is provided with a locking member.

9. The method of claim 6 wherein said plate is provided with means for engaging said leg member.

10. The method of claim 6 wherein said plate has an opening suitably disposed therein to admit a displacement member.

11. A method of making a unitary pattern assembly useful in forming investment shell molds for the conventional and directional solidification of molten metals and alloys comprising the steps of:

a. providing a fixture, said fixture comprising a yoke, having a first pattern capturing means, rigidly engaged to a second pattern capturing means, whereby said capturing means are rigidly spaced in open opposed relationship a predetermined distance from one another, the fixture being removable after investment molding and before casting and solidification;
b. providing a mold structure having a cavity therein;
c. positioning the mold structure and the fixture to expose said capturing means to the cavity;
d. forming a pattern in the cavity, said pattern being fixedly captured at each end by said capturing means; and
e. removing the mold structure from the pattern, said pattern remaining fixedly captured by said capturing means.

12. The method of claim 11 wherein said yoke is provided with handle means.

13. The method of claim 12 wherein said handle means is adapted to engage a manipulating device.

14. A method of making a unitary pattern assembly useful in forming an investment shell mold having an integral base, for the directional solidification of molten metals and alloys comprising the steps of:

a. providing a fixture, said fixture having first and second pattern capturing means rigidly spaced in open opposed relationship a predetermined distance from one another, the fixture being removable after investment molding and before casting and solidification;
b. providing a mold structure, said structure having a cavity comprising a pattern section and base section;
c. positioning the mold structure and the fixture to expose said first capturing means to the pattern section and said second capturing means to the base section of the cavity;
d. forming a pattern having a base integral therewith in the cavity, said pattern being fixedly captured at its end by said first capturing means and said base being fixedly captured by said second capturing means; and
e. removing the mold structure from the pattern and integral base, said pattern and integral base remaining fixedly captured by said capturing means in the fixture.

15. The method of claim 14 wherein said fixture is comprised of a support member, having a first pattern capturing means, rigidly spaced from the second pattern capturing means by at least one leg member.

16. The method of claim 15 wherein said first pattern capturing means is an elongated member extending from the support member toward the second pattern capturing means.

17. The method of claim 16 wherein said member is in the shape of a finned cylinder.

18. The method of claim 15 wherein said first pattern capturing means is provided by said support member having a recess therein.

19. The method of claim 15 wherein said second pattern capturing means is a plate.

20. The method of claim 19 wherein said plate is provided with a roughened area thereon.

21. The method of claim 19 wherein said plate is provided with a locking member.

22. The method of claim 19 wherein said plate is provided with means for engaging said leg member.

23. The method of claim 19 wherein said plate has an opening suitably disposed therein to admit a displacement member.

24. The method of claim 1 wherein said capturing means are rigidly spaced from one another in substantially parallel alignment.

25. The method of claim 1 wherein said predetermined distance is related to the length of the pattern to be formed.

26. The method of claim 1 wherein the cavity is substantially in the shape of a gas turbine engine blade.

27. The method of claim 1 wherein an insert is placed in the cavity prior to forming the pattern.

28. The method of claim 1 wherein the pattern is formed from molten wax injection into the cavity.

29. A method of making a unitary pattern assembly useful in forming multiple, individual investment shell molds for the conventional and directional solidification of molten metals and alloys comprising the steps of:

a. providing a fixture, said fixture having a plurality of first pattern capturing means rigidly spaced a predetermined distance from second pattern capturing means, each first pattern capturing means being associated with a single pattern to be formed;
b. providing a mold structure having a cavity therein;
c. positioning the mold structure and the fixture to expose one first pattern capturing means and second pattern capturing means to the cavity;
d. forming a pattern in the cavity, said pattern being fixedly captured at each end by said capturing means;
e. removing the mold structure from the pattern, said pattern remaining fixedly captured by said capturing means in the fixture; and
f. repeating steps c through e until the desired number of patterns is formed and fixedly captured.

30. A method of making a unitary pattern assembly useful in forming a cluster of multiple investment shell molds for the conventional and directional solidification of molten metals and alloys comprising the steps of:

a. providing a fixture, said fixture having a first and second pattern capturing means rigidly spaced in open opposed relationship a predetermined distance from one another, the fixture being removable after investment molding and before casting and solidification;
b. providing a mold structure, said structure having a cavity in the shape of a pattern cluster;
c. positioning the mold structure and the fixture to expose said capturing means to the cavity;
d. forming the pattern cluster in the cavity, said cluster being fixedly captured at each end by said capturing means; and
e. removing the mold structure from the pattern cluster, said cluster remaining fixedly captured by said capturing means in the fixture.

31. A method of making a unitary pattern assembly useful in forming a cluster of multiple investment shell molds for the conventional and directional solidification of molten metals and alloys comprising the steps of:

a. providing a fixture, said fixture having first and second pattern capturing means rigidly spaced a predetermined distance from one another;

b. providing a mold structure, said structure having a cavity in the shape of a partial pattern cluster;

c. positioning the mold structure and the fixture to expose said capturing means to the cavity;

d. forming the partial pattern cluster in the cavity, said partial cluster being fixedly captured at each end by said capturing means;

e. removing the mold structure from the partial pattern cluster, said partial cluster remaining fixedly captured by said capturing means; and f. repeating steps c through e until a complete pattern cluster is formed and fixedly captured.

32. In a method of investment casting wherein a shell is formed on a pattern, the improvement which comprises:

a. making a unitary pattern assembly comprising the steps of:

1. providing a fixture, said fixture having first and second pattern capturing means rigidly spaced a predetermined distance from one another;

2. providing a mold structure having a cavity therein;

3. positioning the mold structure and the fixture to expose said capturing means to the cavity;

4. forming a pattern in the cavity, said pattern being fixedly captured at each end by said capturing means;

5. removing the mold structure from the pattern, said pattern remaining fixedly captured by said capturing means in the fixture;

b. forming a shell on the assembly;

c. separating the shelled pattern and shelled fixture; and d. cleaning the fixture to remove the shell thereon and to prepare the fixture for reuse in steps a through c.

* * * * *